US009689185B2

(12) United States Patent
McInnis

(10) Patent No.: US 9,689,185 B2
(45) Date of Patent: Jun. 27, 2017

(54) ADJUSTABLE HINGE FOR VERTICALLY HANGING PANEL

(71) Applicant: Caldwell Manufacturing Company North America, LLC, Rochester, NY (US)

(72) Inventor: James McInnis, Hilton, NY (US)

(73) Assignee: Caldwell Manufacturing Company North America, LLC, Rochester, NY (US)

( * ) Notice: Subject to any disclaimer, the term of this patent is extended or adjusted under 35 U.S.C. 154(b) by 0 days.

(21) Appl. No.: 15/259,111

(22) Filed: Sep. 8, 2016

(65) Prior Publication Data

US 2017/0074014 A1 Mar. 16, 2017

Related U.S. Application Data

(60) Provisional application No. 62/216,648, filed on Sep. 10, 2015.

(51) Int. Cl.
*E05D 7/04* (2006.01)
*E05D 11/00* (2006.01)
(Continued)

(52) U.S. Cl.
CPC ..... *E05D 7/0423* (2013.01); *E05D 3/02* (2013.01); *E05D 3/022* (2013.01); *E05D 3/04* (2013.01);
(Continued)

(58) Field of Classification Search
CPC ... E05D 7/0423; E05D 7/0018; E05D 7/0027; E05D 2003/025; E05D 2007/0469; E05D 3/02; E05D 3/022; E05D 3/04; E05D 11/00; E05D 11/02; E05D 11/0639; E05D 11/0634; E05D 11/26; E05D 11/063; Y10T 16/5325; Y10T 16/537; Y10T 16/35; Y10T 16/3543; Y10T 16/373; Y10T 16/375;
(Continued)

(56) References Cited

U.S. PATENT DOCUMENTS 525,712 A * 9/1894 Knittel ..... E05D 7/0027 16/244
1,821,697 A * 9/1931 Ferris ..... E05D 15/12 16/104
(Continued)

FOREIGN PATENT DOCUMENTS

AU GB 2402192 A * 12/2004 ..... E05D 15/0634
CH 690504 A5 * 9/2000 ..... E05D 15/0639
(Continued)

OTHER PUBLICATIONS

Extended European Search Report for EP 16188217.0, dated Feb. 10, 2017; EPO.

*Primary Examiner* — Chuck Mah
(74) *Attorney, Agent, or Firm* — Harness, Dickey & Pierce, P.L.C.

(57) ABSTRACT

A hinge assembly is disclosed that may include one or more leaves that can be connected to a panel. The hinge assembly may further include a barrel having a passage through which a pivot pin passes. A spacer is positioned in an opening between a first barrel section and a second barrel section. Bushings are disposed within the first and second barrel sections.

16 Claims, 3 Drawing Sheets

(51) Int. Cl.

| | |
|---|---|
| ***E05D 15/06*** | (2006.01) |
| ***E05D 3/02*** | (2006.01) |
| ***E05D 3/04*** | (2006.01) |
| ***E05D 7/00*** | (2006.01) |
| ***E05D 15/26*** | (2006.01) |
| ***E05D 15/02*** | (2006.01) |

(52) U.S. Cl.
CPC ..... *E05D 7/0027* (2013.01); *E05D 11/00* (2013.01); *E05D 15/02* (2013.01); *E05D 15/0639* (2013.01); *E05D 15/26* (2013.01); *E05D 2003/025* (2013.01); *E05D 2007/0469* (2013.01); *E05Y 2201/632* (2013.01)

(58) Field of Classification Search
CPC ..... Y10T 16/3825; Y10T 16/3834; E05Y 2201/632
See application file for complete search history.

(56) References Cited

U.S. PATENT DOCUMENTS 2,000,856 A * 5/1935 Lyons ..... E05D 3/02 16/276
2,010,659 A * 8/1935 Ferris ..... E05D 11/04 16/276
2,279,966 A * 4/1942 Bulkley ..... F24F 6/04 137/78.5
3,499,183 A * 3/1970 Parsons ..... E05D 5/10 16/273
3,921,225 A * 11/1975 Suska ..... E05D 3/02 16/273
5,127,132 A * 7/1992 Karlin ..... E05D 7/1044 16/261
5,463,795 A * 11/1995 Carlson ..... E05D 5/14 16/273
5,472,037 A * 12/1995 Hoffman ..... E05D 7/009 160/118
6,618,900 B2 9/2003 Spork et al.
6,834,703 B2 12/2004 Pacholke et al.
7,246,412 B2 7/2007 Pacholke
7,290,581 B2 * 11/2007 Lee ..... E05D 3/12 16/381
8,191,205 B2 * 6/2012 Forrest ..... E05D 5/14 16/273
8,490,246 B2 * 7/2013 Waddell ..... E05D 7/0423 16/238
8,495,793 B2 * 7/2013 Cayer ..... E05D 7/1044 16/262
8,677,564 B2 3/2014 Pelekanos
8,695,165 B2 4/2014 Pelekanos
8,844,604 B2 9/2014 Pelekanos et al.
9,032,589 B2 5/2015 Pelekanos
9,157,265 B2 10/2015 Pelekanos
9,157,267 B2 10/2015 Pelekanos
2001/0011583 A1 * 8/2001 Spork ..... E05D 15/26 160/199
2006/0156512 A1 * 7/2006 Naylor ..... E05D 5/127 16/273
2008/0235910 A1 * 10/2008 Umback ..... E05D 5/121 16/382
2013/0061427 A1 * 3/2013 Lang ..... E05D 7/0423 16/248
2013/0104341 A1 * 5/2013 Kenerly ..... E05D 3/02 16/273
2015/0000082 A1 * 1/2015 Lang ..... E05D 7/0027 16/248
2015/0330126 A1 11/2015 Ma et al.
2015/0368949 A1 12/2015 Smith
2016/0024826 A1 1/2016 Smith
2016/0047151 A1 2/2016 Pelekanos et al.

FOREIGN PATENT DOCUMENTS

GB 2341199 A 3/2000
IT EP 0616104 A1 * 9/1994 ..... E05D 5/0238
WO WO2008/090447 A2 7/2008

* cited by examiner

ADJUSTABLE HINGE FOR VERTICALLY HANGING PANEL

CROSS-REFERENCE TO RELATED APPLICATIONS

This application claims the benefit of U.S. Provisional Application No. 62/216,648, filed on Sep. 10, 2015. The entire disclosure(s) of the above application is incorporated herein by reference.

FIELD

The subject disclosure relates to a hinge assembly, and particularly to an adjustable height hinge assembly, for a vertically hanging panel of a foldable barrier.

BACKGROUND

This section provides background information related to the present disclosure which is not necessarily prior art.

Vertically-hanging, foldable barriers can include doors, walls, screens, shutters, and partitions, each having multiple sections or panels joined together and adjacent to one another to form a barrier that can be opened and closed by folding or stacking the panels against one another. Hinge hardware can be installed between adjacent panels to allow them to rotate relative to one another to facilitate opening and closing the barrier.

A hinge assembly can include a hinge plate having a barrel and at least one leaf. The barrel has a passageway through which a hinge pin or pivot pin is placed or passes. Extending from the barrel may be one or more leafs that can include throughbores or apertures that allow for the passage of fasteners, such as screws, to attach the hinge plate to a panel. The barrel may generally extend the length of the leaf. If the pivot pin is passed therethrough, the barrel generally extends at least the length of the pivot pin. The pivot pin may be connected to a fastening portion, such as a header, a connector in a header, or carriage, for example, to facilitate vertically hanging the panel.

SUMMARY

This section provides a general summary of the disclosure, and is not a comprehensive disclosure of its full scope or all of its features.

In one aspect of the present disclosure, an adjustable height hinge assembly for a vertically-hanging panel of a foldable barrier is described. The hinge assembly includes a hinge plate, a plurality of bushings, a spacer and a hinge pin. The hinge plate has a generally planar leaf portion and a tubular barrel portion extending along a longitudinal axis from a first end to a second end that is adjacent to and integrally formed with the leaf portion. The leaf portion has a plurality of apertures through which fasteners can affix the hinge plate to the hanging panel.

The barrel portion comprises a keyhole located intermediate its opposite ends that separates the barrel portion into a first barrel section and a second barrel section. The first barrel section includes a first passageway and the second barrel section includes a second passageway, each passageway extending through an entire length of the respective barrel section and being aligned along the longitudinal axis of the barrel portion.

A plurality of bushings includes a first bushing, a second bushing and a third bushing. Each of the bushings has a flange portion and a body portion comprising an inner bearing surface having an inner diameter.

The hinge pin has a head, a shaft, and a threaded terminal end that can engage an overhead receiver from which the vertically-hanging panel is suspended. The pin passes through the first bushing, the first barrel section, the second bushing, the spacer, the third bushing and the second barrel section. When assembled, the head of the pin engages the first flange portion of the first bushing.

The spacer is disposed within the keyhole between the first barrel section and the second barrel section and comprises a third passageway with an inner diameter that is greater than the outer diameter of the hinge pin. The third passageway is aligned with the first and second passageways along the longitudinal axis. The spacer aids in preventing the second bushing and/or the third bushing from backing out of the respective barrel section in which it is installed.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
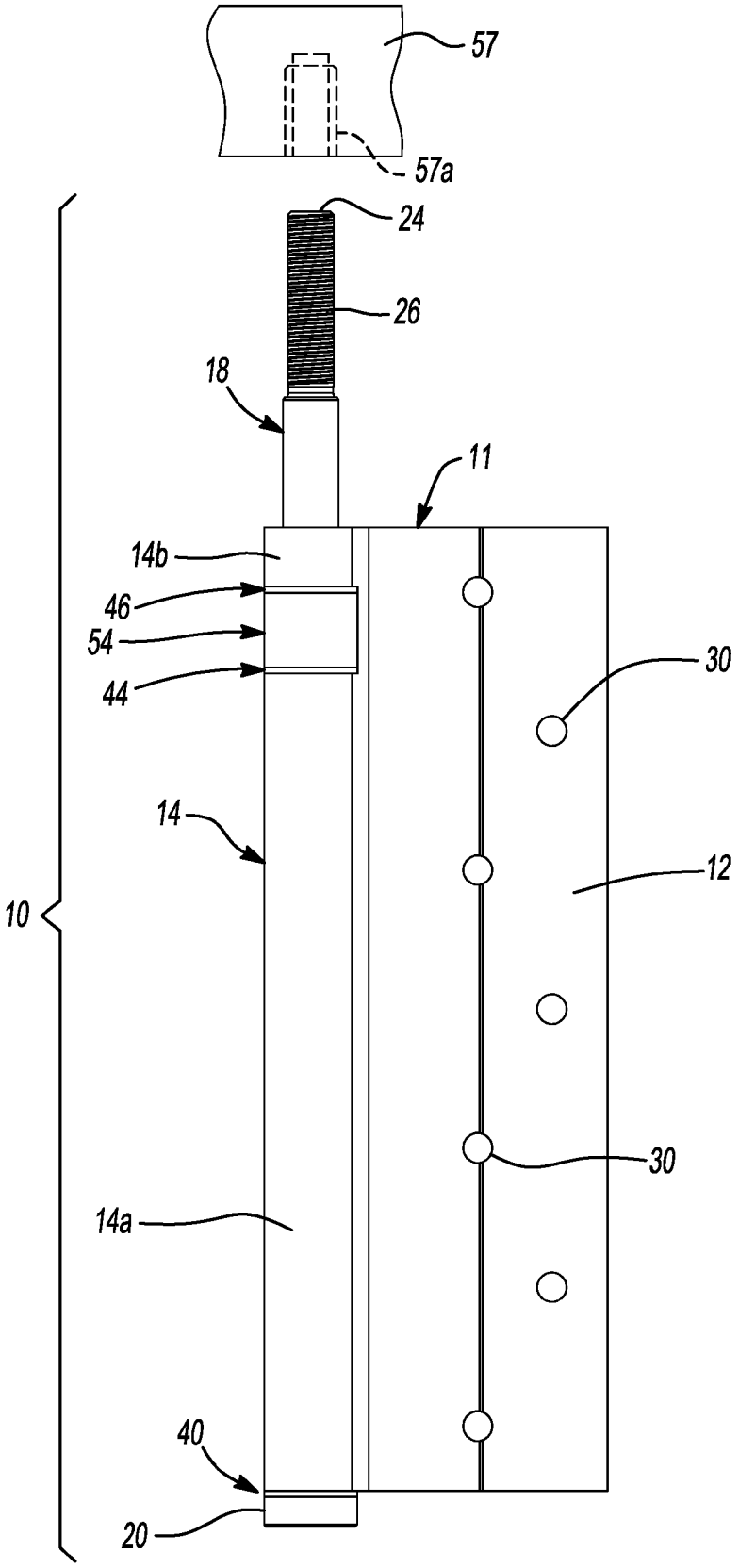
FIG. 1 is a front view of an adjustable height hinge assembly according to the principles of the present disclosure.
Figure 2:
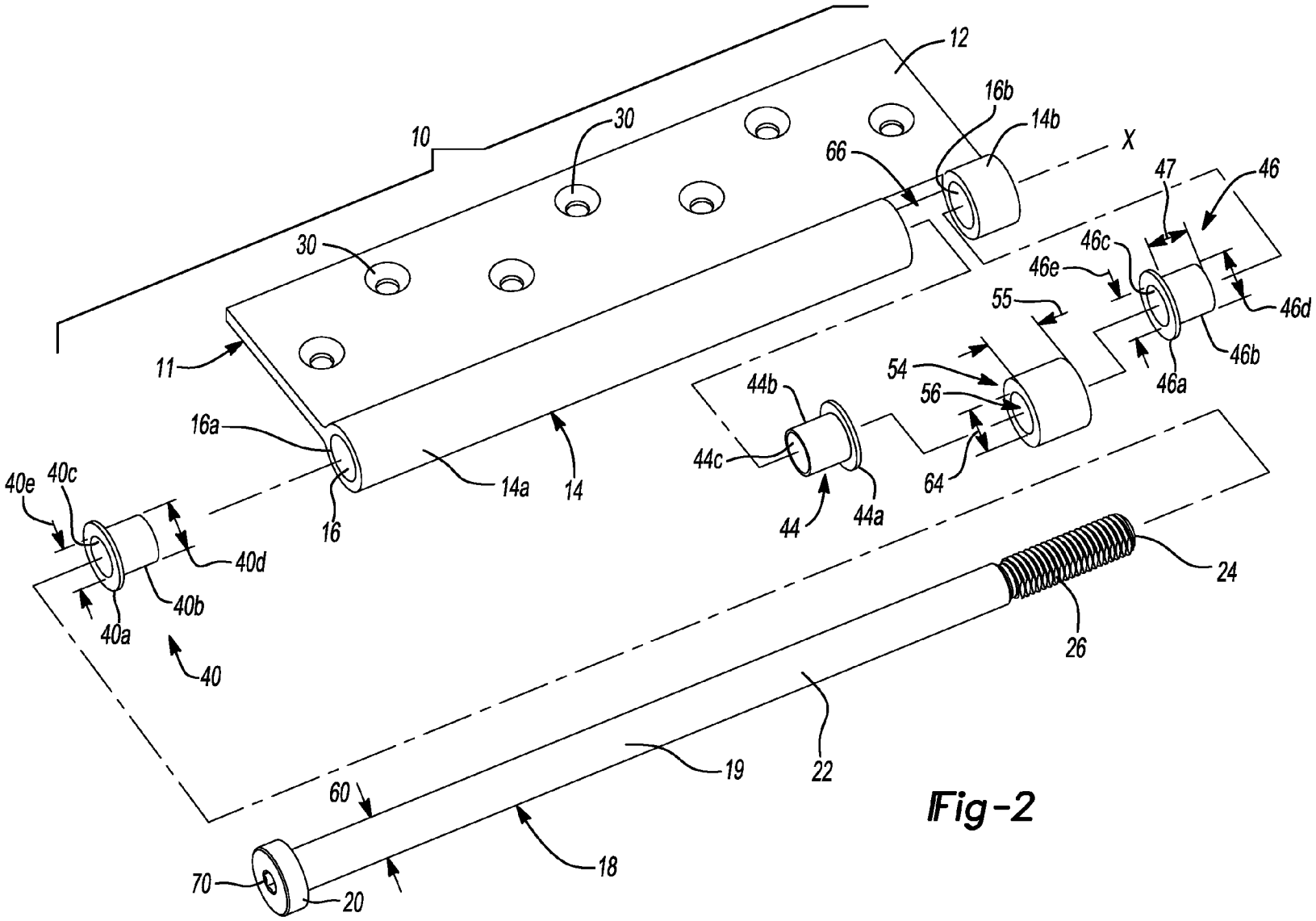
FIG. 2 is an exploded perspective view of the adjustable height hinge assembly of FIG. 1.

An adjustable height hinge assembly 10 for a vertically hanging panel of a foldable barrier according to the principles of the present disclosure is illustrated in FIGS. 1 and 2. As shown in the figures, the hinge assembly 10 can generally include a hinge plate 11, having a leaf portion 12 and a barrel portion 14, a pivot pin or hinge pin 18, a plurality of bushings, e.g., a first bushing 40, second bushing 44 and third bushing 46, and a spacer 54. With reference to FIG. 2, an exploded perspective view of the hinge assembly 10 is illustrated with the pin 18, bushings 40, 44, and 46 and spacer 54 disassembled from the hinge plate 11.

Figure 3:
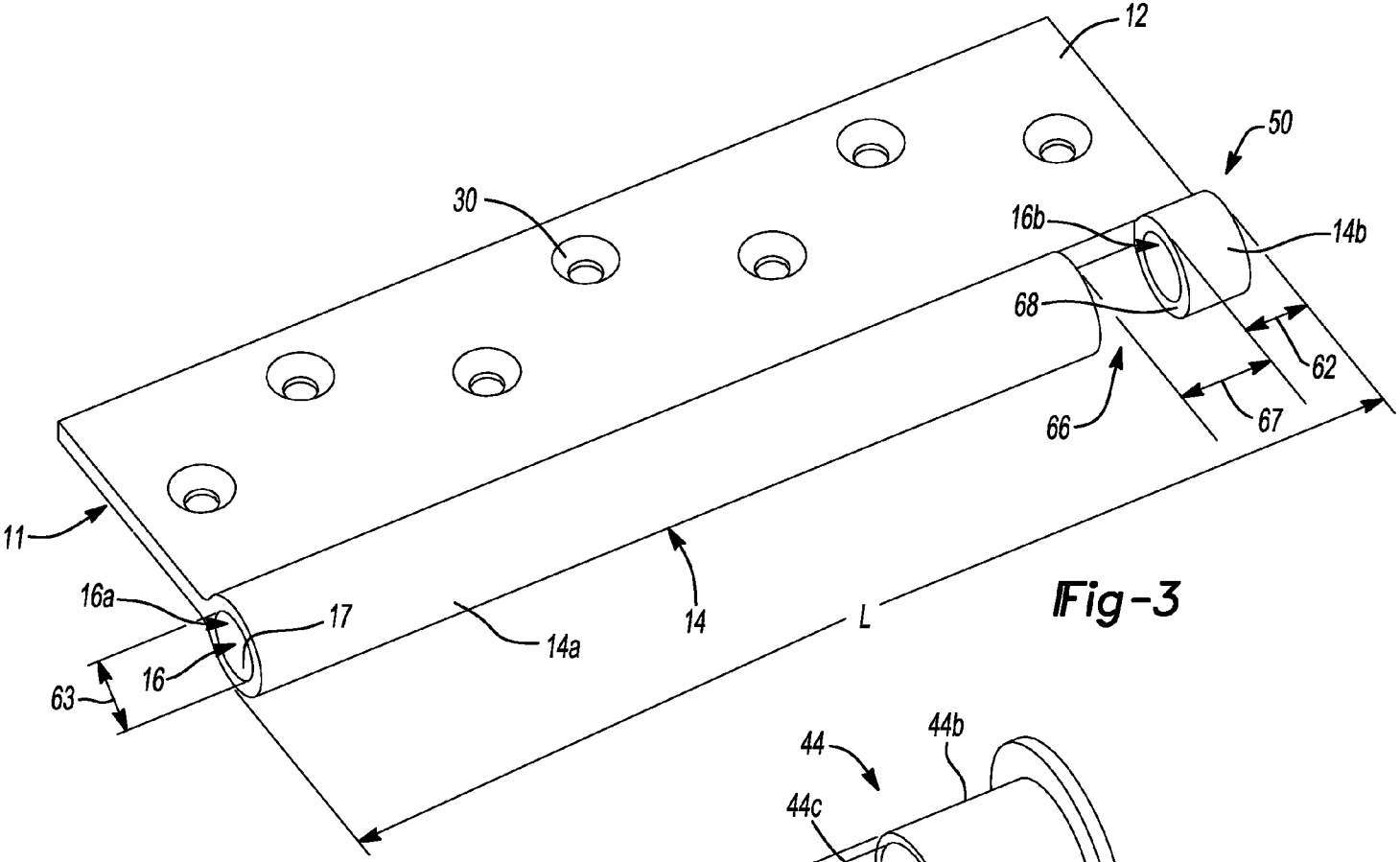
FIG. 3 is a perspective view of the hinge plate of the adjustable height hinge assembly of FIG. 1.

Referring additionally to FIG. 3, the hinge plate 11 includes a generally planar leaf portion 12 and a generally tubular barrel portion 14 extending along a longitudinal axis X that is adjacent to and integrally formed with the leaf portion 12. The leaf portion 12 may include one or more through-bores or apertures 30 through which a corresponding number of fasteners (not shown) may pass to affix the hinge plate 11 to an associated panel of the barrier. A fastener may include a screw, a bolt, a rivet or other appropriate fastener. The fastener may affix hinge plate 11, and thus the hinge assembly 10, to a panel of a barrier. Also, more than one leaf portion may be provided. In addition, if more than one leaf portion is provided, each leaf portion may be a mirror image of the other (e.g., a non-handed leaf) or one may be non-handed while the other is handed (i.e., right- or left-hand oriented).

The tubular barrel portion 14 may include a passageway 16 extending through its entire length L. A cut-out or keyhole 66 is located intermediate the longitudinal length of the barrel portion 14 and separates the barrel portion 14 into separate sections, such as a first barrel section 14*a* and a second barrel section 14*b*. The keyhole 66 has a width dimension 67 along the longitudinal axis X. The width 67 of the keyhole 66 spaces the first barrel section 14*a* from the second barrel section 14*b*. Each of the first and second barrel sections 14*a*, 14*b*, may include a portion 16*a*, 16*b* of the entire passageway 16 through which a pivot pin 18 passes. In this regard, the first barrel section includes a first passageway 16*a* extending through an entire length of the first barrel section 14*a* and the second barrel section includes a second passageway 16*b* extending through the entire length of the second barrel section 14*b*. The passageways 16*a*, 16*b* are aligned along the longitudinal axis X.

The pivot pin 18 may include a head portion 20, a shaft 22, and a terminal end 24 that is opposite the head portion 20. Near the terminal end 24 may be one or more threads 26 that can engage a threaded bore 57*a* in an overhead receiver, e.g., a header or a movable carriage (partially shown at 57) for a vertically hanging, foldable barrier assembly (not shown). For example, a fixation portion for a vertically hanging foldable door assembly including a plurality of door panels may include a threaded bore into which the threads 26 near the terminal end 24 are engaged. The length of the threaded section 26 can allow for vertical adjustment of the panel relative to the overhead receiver 57 during installation of the panel with the hinge assembly 10. The head portion 20 may include an engagement feature for vertically adjusting the hinge assembly during and after installation, as discussed further herein.

The hinge assembly 10, including the pivot pin 18 that has passed through the passageway 16, can further include one or more bushings, such as a first bushing 40 positioned at a first end 42 of the barrel portion 14 and near the head 20, a second bushing 44, and a third bushing 46. Each of the second and third bushings 44, 46 can be positioned near a second terminal end 50 of the barrel section 14 and near the terminal end 24 of the pivot pin 18. The second and third bushings 44, 46 can be held substantially fixed in place by a retaining spacer 54.

The spacer 54 may have a hollow, cylindrical shape having a thickness 55. The spacer 54 further forms a passageway 56 through which the pivot pin 18 passes and which may be aligned with both of the passageways 16*a*, 16*b* of the first and second barrel sections 14*a*, 14*b*. When the passageway 56 through the spacer 54 is aligned with the passageways 16*a*, 16*b* in the barrel sections 14*a*, 14*b*, during the assembly of the hinge assembly 10 the pivot pin 18 may be passed through the passageways 16*a*, 16*b* of the barrel portion 14 and the passageway 56 of the spacer 54. In this manner, the spacer 54 may retain the bushings 44, 46 in position even if the pivot pin 18 is movable or rotatable relative to the barrel portion 14 and the leaf portion 12 of the hinge plate 11.

When the pivot pin 18 is assembled with the hinge plate 11 (i.e., inserted through the barrel portion 14), the head portion 20 may assist in holding the bushing 40 within the passageway 16*a* of the first barrel section 14*a*.

The leaf portion 12 and the barrel portion 14 of the hinge plate 11 may be formed of a first material, such as aluminum. The pin 18 may be formed of a second material, such as steel, hardened steel, stainless steel or other materials. Therefore, the pin 18 may be formed of a material that is harder than the material that forms the barrel 14 of the hinge assembly 10. During use, rotation of the leaf portion 12 and barrel portion 14 relative to the pin 18 may cause deformation of the passageway 16 of the barrel portion 14. To eliminate or reduce the possible deformation of the passageway 16 through the barrel portion 14, the bushings 40, 44, and 46 may be placed in the passageway 16. The bushings may eliminate or reduce direct contact between an outer bearing surface 19 of the pin 18 and the interior wall 17 of the passageway 16.

Figure 4:
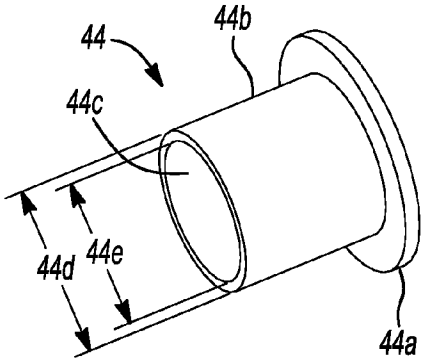
FIG. 4 is a perspective view of a bushing of the adjustable height hinge assembly of FIG. 1.

Turning also to FIG. 4, the bushings 40, 44, 46 each may include a flange portion 40*a*, 44*a*, 46*a*, respectively. Extending from the respective flange portions may be body portions 40*b*, 44*b*, 46*b*, respectively. Further, each of the bushings 40, 44, 46 may include inner bearing surfaces 40*c*, 44*c*, 46*c*, respectively. The bushings 40, 44 and 46 closely fit within the passageway 16 of the barrel portion 14 of the hinge plate 11. For example, each of the respective bodies 40*b*, 44*b*, 46*b* may have an external dimension, such as an outer diameter (OD) 40*d*, 44*d*, 46*d*, that is dimensioned in close tolerance with an internal dimension, such as inner diameter (ID) 63, of the passageway 16. For example, the outer diameter 40*d* of the body, such as the body 40*b*, may be about 0.010 inches to about 0.001 inches smaller than the inner diameter 63 of the passageway 16. The dimensions of the bodies 44*b* and 46*b* of the bushings 44 and 46, respectively, may also be the same relative to the internal diameter 63 of the passageway 16. Alternatively, the respective bodies 40*b*, 44*b* and 46*b* of the bushings 40, 44 and 46 can be press-fit and secured within the passageway 16 of the barrel portion 14 of the hinge plate 11.

The bushings 40, 44 and 46 also have a close fit with the hinge pin 18. For example, each of the bushings 40, 44 and 46 can also include respective inner bearing surfaces 40*c*, 44*c*, and 46*c*. The bushings' respective inner bearing surfaces 40*c*, 44*c*, 46*c* may have an internal dimension, such as an inner diameter (ID) 40*e*, 44*e*, 46*e*, that is dimensioned in close tolerance with the hinge pin 18. For example, the pin 18 may include an outer bearing surface having an outer dimension, such as an outer diameter (OD) 60, that is dimensioned about 0.100 to about 0.001 inches smaller than the inner diameter 40*e*, 44*e*, 46*e* of the inner bearing surfaces 40*c*, 44*c*, and 46*c*. This allows the pin 18 to pass through the bushings 40, 44, and 46 when the bushings 40, 44, and 46 are positioned within the passageway 16 of the barrel portion 14. When the pin 18 passes through the bushings 40, 44, 46, the pin 18 engages the bushings 40, 44, 46 and does not directly contact the barrel portion 14. Further, the body 46*b* of the bushing 46 may include a dimension 47 that can be substantially equal to a length 62 of the barrel section 14*b* and terminate at the end 50. Therefore, the body 46*b* of the bushing 46 may cover the entire length to the terminal end 50 of the barrel section 14*b*. The flange 46*a* of the bushing 46 also engages second end 68 of the barrel portion 14*b*.

The spacer 54 may be inserted between the bushings 44 and 46 after the bushings are positioned within the passageway 16 of the barrel portion 14. The spacer 54 serves to fill the space be created by keyhole 66 between the barrel sections 14*a*, 14*b* and inhibit the bushings 44 and 46 from "backing out" of the passageway 16 of the barrel portion 14 during operation of the hinge assembly 10. The spacer 54 includes a passageway 56 that allows the pin 18 to pass through the spacer 54. The passageway 56 may include an internal dimension, such as an inner diameter (ID) 64 that tolerance relative to the external dimension 60 of the pin 18 as opposed to the dimension 40*e*, 44*e*, 46*e* of the inner bearing surfaces 40*c*, 44*c*, 46*c* of bushings 40, 44, and 46. It is understood, however, that the passageway 56 of the spacer 54 may include a tolerance relative to the external dimension 60 of the pin 18 that is equivalent to the tolerance relative to the dimension 40*e*, 44*e*, 46*e* of the inner bearing surfaces 40*c*, 44*c*, and 46*c*.

The spacer 54 may be formed of the same first material as the barrel portion 14 or may be formed of a different material, such as stainless steel. The spacer 54 generally contacts the flange 44*a* and 46*a*, respectively, of the bushings 44 and 46. Therefore, the spacer 54 does not generally directly contact the barrel portion 14. The spacer 54, however, is positioned to eliminate or/and reduce eliminate movement of the bushing members 44, 46 relative to the barrel portion 14 when the pain 18 is positioned and/or moves relative to the barrel portion 14.

The bushing members 40, 44, and 46 can be formed of a polymer material, such as polyphenol sulfide (PPS), or a metal alloy. The bushings 40, 44, and 46 provide a bearing surface between the pin 18 and the passageway 16 of the barrel portion 14. In general, the material from which the bushings 40, 44, and 46 are formed may be rigid and relatively fragile. Therefore, providing a one-piece bushing member which extends the entire length of the passageway 16 through the barrel portion 14 may be difficult or impossible. A one-piece bushing that would have to be pushed through the passageway which extends the entire length of the hinge plate 11 may generally crack or fracture, thus leading to failure of the bushing. The separate bushings 40, 44, and 46, therefore, may be inserted at multiple locations along the barrel portion 14 of the hinge plate 11 such that each bushing body portion 40*b*, 44*b* and 46*b* extends only a short distance into the passageway 16 of the barrel portion 14. For example, the body portions 40*b*, 44*b*, and 46*b* may be about 0.2 inches to about 0.8 inches long and extending into the passageway portion 16.

During assembly, with reference to FIG. 2, each of the bushing members 40, 44, and 46 may have their respective body portions 40*b*, 44*b*, and 46*b* inserted into the passageway 16 of the barrel portion 14. Notably, bushings 40 and 46 are inserted into the passageway 16 vertically upwardly, and the bushing 44 is inserted into the passageway 16 in the opposite direction, vertically downwardly. The spacer 54, then, may be positioned within the keyhole 66 formed between a first barrel section 14*a* and a second barrel section 14*b* of the barrel portion 14, between the respective flange portions 44*a*, 44*b* of the bushings 44 and 46.

The pin 18 may then be inserted vertically upwardly into the passageway 16 of the barrel portion 14. Beginning at the vertically lower end of the barrel portion 14 of the hinge plate 11, the pin 18 first passes through the body 40*b* of the bushing 40, and then along the length of the first barrel section 14*a*. At the upper end of the first barrel section 14*a*, the pin 18 passes through the body portion 44*b* of the second bushing 44 and then into the spacer 54. Notably, the spacer 54, positioned in the key hole 66 between the bushing 44 and bushing 46, aids in preventing the bushing 44 from becoming dislodged or "backing out" from assembly with the first barrel section 14*a* of the barrel portion 14 as the pin 18 travels upwardly through the barrel portion 14, against the direction of installation of the bushing 44 in the first barrel section 14*a*. Continuing the upward insertion of the pin 18 through the barrel portion 14 of the hinge plate 11, the pin 18 passes through the spacer 54 and into the body portion 46*b* of the third bushing 46 (which may or may not occupy the entire length of the second barrel section 14*b*), and then finally through the terminal end 50 of the second barrel section 14*b* and entirely through the hinge plate 11.

Once in place, the pin 18 prevents the spacer 54 from separating from the hinge plate 11. In a similar manner as previously described, the spacer 54 holds further aids in preventing the bushings 44 and 46 from becoming dislodged or "backing out" from assembly with the respective barrel sections 14*a*, 14*b* of the barrel portion 14 during assembly of the hinge assembly 10, installation of the hinge assembly 10, and vertical adjustment of the hinge assembly 10.

During installation and adjustment of the hinge assembly 10, the pin 18 may be rotated so that the male threaded portion 26 can engage a female threaded bore 57*a* in the overhead receiver 57 and to enable vertical movement of the pin 18 and corresponding vertical adjustment of the hinge assembly 10 (including the leaf portion 12 which can be affixed to a vertically hanging panel of a foldable barrier. Rotation of the pin 18 can be enabled by a tool (not shown) that can engage a tool engagement receptacle or opening 70 in the head portion 20 of the pin 18. Rotation of the pin 18 therefore, allows respective movement of the panel to which the hinge assembly 10 is affixed.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An adjustable height hinge assembly for a vertically-hanging panel of a foldable barrier, the hinge assembly comprising:

a hinge plate;

a plurality of bushings;

a spacer; and a hinge pin;

wherein the hinge plate comprises a generally planar leaf portion and a tubular barrel portion extending along a longitudinal axis from a first end to a second end;

wherein the barrel portion is adjacent to and integrally formed with the leaf portion;

wherein the leaf portion comprises a plurality of apertures for accommodating a corresponding plurality of fasteners for affixing the hinge plate to the panel;

wherein the barrel portion comprises a keyhole located intermediate the first end and the second end, wherein the keyhole separates the barrel portion into a first barrel section and a second barrel section;

wherein the first barrel section includes a first passageway and the second barrel section includes a second passageway, the first passageway extending through an entire length of the first barrel section and the second passageway extending through an entire length of the second barrel section;

wherein the first passageway and the second passageway are aligned along the longitudinal axis;

wherein the plurality of bushings comprises a first bushing, a second bushing and a third bushing;

wherein each of the plurality of bushings comprises a flange portion, and a body portion comprising an inner bearing surface having an inner diameter;

wherein the pin comprises a head, a shaft, and a threaded terminal end;

wherein the pin passes through the first bushing, the first barrel section, the second bushing, the spacer, the third bushing and the second barrel section;

wherein the head of the pin engages the first flange portion of the first bushing;

wherein the spacer is disposed within the keyhole between the first barrel section and the second barrel section;

wherein the spacer comprises a third passageway comprising an inner diameter which is greater than the outer diameter of the pin;

wherein the third passageway is aligned with the first passageway and the second passageway along the longitudinal axis; and wherein the spacer prevents at least one of the second bushing and the third bushing from backing out of the respective barrel section in which it is installed.

2. The adjustable height hinge assembly of claim 1, wherein the third bushing extends substantially an entire length of the second barrel section.

3. The adjustable height hinge assembly of claim 1, wherein each of the plurality of bushings further comprises an outer bearing surface having an outer diameter.

4. The adjustable height hinge assembly of claim 1, wherein at least one of the first bushing and second bushing is press-fit into the first passageway of the first barrel section; and wherein the third bushing is press-fit into the second passageway of the second barrel section.

5. The adjustable height hinge assembly of claim 1, wherein the pin comprises an outer bearing surface for engaging the respective inner bearing surfaces of the plurality of bushings, the outer bearing surface comprising an outer diameter that is less than or equal to a dimension of the inner bearing surfaces of the plurality of bushings; and wherein the pin is configured to be moveable relative to the barrel portion of the hinge plate.

6. The adjustable height hinge assembly of claim 1, wherein the spacer has a thickness less than or equal to a width of the keyhole along the longitudinal axis.

7. The adjustable height hinge assembly of claim 6, wherein opposite ends of the spacer along the longitudinal axis engage the respective flange portions of the second and third bushings.

8. The adjustable height hinge assembly of claim 1, wherein the hinge pin further comprises a receptacle in the head portion for engaging a tool for rotating the hinge pin.

9. An adjustable height hinge assembly for a vertically-hanging panel of a foldable barrier, the hinge assembly comprising:

a hinge plate comprising a generally planar leaf portion and a tubular barrel portion positioned adjacent to the leaf portion and extending along a longitudinal axis from a first end to a second end;

wherein the barrel portion comprises a single keyhole located intermediate the first end and the second end that separates the barrel portion into a first barrel section and a second barrel section;

a first bushing disposed within the first barrel section at the first end of the barrel portion, a second bushing disposed within the first barrel section at the keyhole, and a third bushing disposed within the second barrel section at the keyhole and opposite to the second bushing;

a spacer disposed within the keyhole between the first barrel section and the second barrel section;

a hinge pin passing through the first bushing, the second bushing, the spacer, and the third bushing and comprising a head and a threaded terminal end, wherein the head engages a flange portion of the first bushing and wherein the pin comprises an outer bearing surface engaging an inner bearing surface of each of the first, second and third bushings;

wherein the spacer is positioned adjacent to the second bushing and the third bushing such that the spacer prevents each of the second bushing and the third bushing from backing out of its respective barrel section in which it is disposed.

10. The adjustable height hinge assembly of claim 9, wherein the outer bearing surface has an outer diameter that is less than or equal to a dimension of the inner bearing surfaces of the plurality of bushings; and wherein the pin is configured to be moveable relative to the barrel portion of the hinge plate.

11. The adjustable height hinge assembly of claim 9, wherein the spacer has a thickness less than or equal to a width of the keyhole along a longitudinal axis of the barrel portion;

wherein the first barrel section includes a first passageway and the second barrel section includes a second passageway, the first passageway extending through an entire length of the first barrel section and the second passageway extending through an entire length of the second barrel section;

wherein the first passageway and the second passageway are aligned along the longitudinal axis; and wherein the third bushing extends substantially the entire length of the second barrel section.

12. The adjustable height hinge assembly of claim 9, wherein the leaf portion comprises a plurality of apertures for accommodating a corresponding plurality of fasteners for affixing the hinge plate to the panel.

13. The adjustable height hinge assembly of claim 9, wherein each of the plurality of bushings comprises a flange portion, and a body portion comprising an inner bearing surface having an inner diameter.

14. The adjustable height hinge assembly of claim 13, wherein opposite ends of the spacer along the longitudinal axis engage the respective flange portions of the second and third bushings.

15. The adjustable height hinge assembly of claim 9, wherein the spacer comprises a third passageway comprising an inner diameter which is greater than an outer diameter of the outer bearing surface of the pin.

16. The adjustable height hinge assembly of claim 15, wherein the third passageway is aligned with the first passageway and the second passageway along the longitudinal axis.

* * * * *